United States Patent [19]

Phade et al.

[11] Patent Number: 4,878,932

[45] Date of Patent: Nov. 7, 1989

[54] CRYOGENIC RECTIFICATION PROCESS FOR SEPARATING NITROGEN AND METHANE

[75] Inventors: Ravindra F. Phade, Getzville; James R. Handley, Amherst, both of N.Y.

[73] Assignee: Union Carbide Corporation, Danbury, Conn.

[21] Appl. No.: 326,727

[22] Filed: Mar. 21, 1988

[51] Int. Cl.[4] ..... F25J 3/02

[52] U.S. Cl. ..... 62/24; 62/29; 62/42

[58] Field of Search ..... 62/11, 23, 24, 32, 29, 62/36, 42

[56] References Cited

U.S. PATENT DOCUMENTS

| | | | |
|---|---|---|---|
| 2,557,171 | 6/1951 | Bodle et al. | 62/175.5 |
| 3,373,574 | 3/1968 | Fisher | 62/20 |
| 3,626,448 | 12/1971 | Crawford et al. | 62/29 |
| 4,217,759 | 8/1980 | Shenoy | 62/23 |
| 4,664,687 | 5/1987 | Bauer | 62/29 |
| 4,710,212 | 12/1987 | Hanson et al. | 62/23 |

*Primary Examiner*—Ronald C. Capossela
*Attorney, Agent, or Firm*—Stanley Ktorides

[57] ABSTRACT

A cryogenic rectification process for the separation of nitrogen and methane wherein feed is preseparated in a high pressure column or phase separator into vapor and liquid portions, the vapor is condensed and at least partly employed as reflux for a main column, the liquid is passed into the main column at an intermediate point, and a portion of the liquid is vaporized against itself to provide additional column vapor upflow.

15 Claims, 2 Drawing Sheets

CRYOGENIC RECTIFICATION PROCESS FOR SEPARATING NITROGEN AND METHANE

TECHNICAL FIELD

This invention relates generally to the separation of nitrogen and methane by cryogenic rectification and is an improvement whereby the separation is performed with improved efficiency and with lower capital costs, especially when the nitrogen concentration in the feed is less than about 35 mole percent.

BACKGROUND ART

One problem often encountered in the production of natural gas from underground reservoirs is nitrogen contamination. The nitrogen may be naturally occurring and/or may have been injected into the reservoir as part of an enhanced oil recovery (EOR) or enhanced gas recovery (EGR) operation. Natural gases which contain a significant amount of nitrogen may not be salable, since they do not meet minimum heating value specifications and/or exceed maximum inert content requirements. As a result, the feed gas will generally be processed to remove heavier components such as natural gas liquids, and then the remaining stream containing primarily nitrogen and methane will be separated cryogenically.

One conventional method of removing the nitrogen contaminant from the natural gas is to pass a stream containing nitrogen and methane to a nitrogen rejection unit (NRU) comprising double cryogenic rectification columns wherein the nitrogen and methane are separated.

Although this conventional method for separating nitrogen and methane has worked reasonably well, a problem related to the nature of rectification has heretofore acted as a detriment to the efficiency of the method.

The problem relates to the fact that the efficiency of the double column cryogenic rectification is hindered at low concentrations of the more volatile component as this reduces the quality of the available reflux for the top of the low pressure column. In the case of a nitrogen-methane mixture, the efficiency of the double-column NRU is significantly reduced when the NRU feed has a nitrogen concentration of less than about 35 mole percent. This results in a significant amount of methane lost in the nitrogen stream exiting the low pressure column. This problem has been addressed by recycling a portion of the nitrogen stream from the NRU separation back to the natural gas feed stream, thus keeping the nitrogen concentration high enough for effective separation. However, this method has two disadvantages. First, use of a nitrogen recycle in this manner increases the NRU plant size reguirements. Second, this process leads to significantly increased power requirements, since relatively pure nitrogen from the exit stream must be separated over again from the natural gas feed.

A recent significant advancement in a double-column NRU process is described in U.S. Pat. No. 4,415,345—Swallow. In this process, a portion of the product nitrogen stream from the low pressure column is rewarmed to ambient temperature, compressed to the pressure level of the high pressure column, and then cooled against the rewarming low pressure nitrogen. This nitrogen stream is then condensed in the high pressure column condenser along with the nitrogen vapor from the high pressure column. By supplementing the amount of nitrogen condensed in this manner, which is often referred to as a nitrogen heat pump, additional nitrogen reflux is available to the low pressure column, thereby permitting a higher percentage recovery of inlet methane. This process has the advantage over the previous state of the art in that a reduction in capital and operating costs is achieved. However, process equipment such as distillation columns and heat exchangers must still be sized for the additional recirculation of nitrogen and a separate nitrogen gas compressor is still required.

Another more recent advancement in such a process is described in U.S. Pat. No. 4,664,686—Pahade. In this process, a stripping column is added to the conventional double column cycle in order to increase the nitrogen concentration of the feed gas to the double column, without requiring nitrogen recompression and recirculation. The addition of the stripping column offers several advantages over the previous state of the art. These advantages include higher methane recovery, decreased operating costs, and increased tolerance to carbon dioxide. However, there is still a significant increase in capital associated with the addition of this stripping column over that of the conventional double column process.

Accordingly, it is an object of this invention to provide an improved process for separating nitrogen and methane.

It is another object of this invention to provide an improved process for separating nitrogen and methane especially when the nitrogen is present in the feed at a concentration not exceeding about 35 mole percent.

SUMMARY OF THE INVENTION

The above and other objects which will become apparent to one skilled in the art upon a reading of this disclosure are attained by this invention which is:

A process for separating nitrogen and methane comprising:

(A) separating a feed comprising methane and nitrogen into a nitrogen-enriched vapor portion and a methane-enriched liquid portion;

(B) condensing the vapor portion and introducing resulting condensed vapor into a main column operating within the range of from 15 to 200 psia;

(C) subcooling the liquid portion and dividing resulting subcooled liguid into first and second parts;

(D) introducing the first part into said main column;

(E) at least partially vaporizing the second part by indirect heat exchange with said subcooling liguid portion;

(F) introducing the at least partially vaporized second part into said main column;

(G) separating the condensed vapor portion, subcooled first part, and at least partially vaporized second part by cryogenic rectification within the main column into nitrogen-richer vapor and methane-richer liguid; and (H) removing nitrogen-richer vapor and methane-richer liquid from the main column.

As used herein the term "subcooled" means a liquid which is at a temperature lower than that liquid's saturation temperature for the existing pressure.

As used herein the term "phase separator" means a device, such as a vessel with top and bottom outlets, used to separate a fluid mixture into its gas and liquid fractions.

The term "column" is used herein to mean a distillation, rectification or fractionation column, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For an expanded discussion of fractionation columns see the Chemical Engineer's Handbook, Fifth Edition, edited by R. H. Perry and C. H. Chilton, McGraw-Hill Book Company, New York Section 13, "Distillation" B. D. Smith et al, page 13-3, *The Continuous Distillation Process.*

The term "double column", is used herein to mean high pressure column having its upper end in heat exchange relation with the lower end of a low pressure column. An expanded discussion of double columns appears in Ruheman, "The Separation of Gases" Oxford University Press, 1949, Chapter VII, Commercial Air Separation.

The terms "nitrogen rejection unit" and "NRU" are used herein to mean a facility wherein nitrogen and methane are separated by cryogenic rectification, comprising a column and the attendant interconnecting equipment such as liquid pumps, phase separators, piping, valves and heat exchangers.

The term "indirect heat exchange" is used herein to mean the bringing of two fluid streams into heat exchange relation without any physical contact or intermixing of the fluids with each other.

DETAILED DESCRIPTION

The process of this invention will be described in detail with reference to the Drawings.

Figure 1:
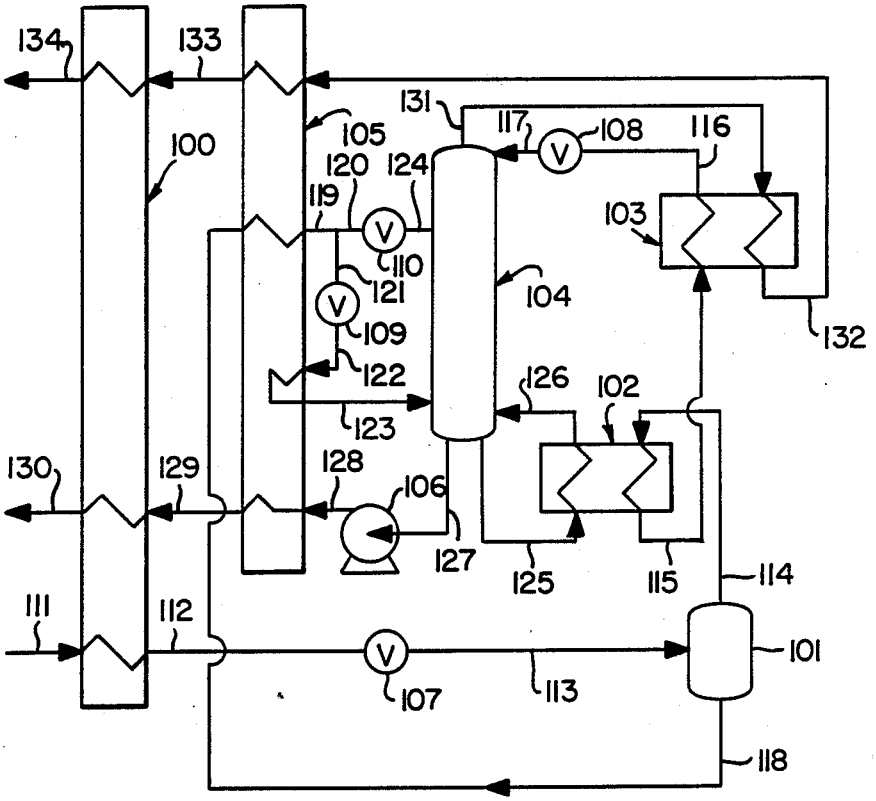
FIG. 1 is a schematic flow diagram of one embodiment of the nitrogen and methane separation process of this invention wherein the feed is separated into nitrogen-enriched vapor and methane-enriched liquid by use of a phase separator.

Referring now to FIG. 1, feed 111 comprising methane and nitrogen is cooled and generally partially condensed by passage through heat exchanger 100. Feed 111 may contain from 5 to 80 mole percent nitrogen and may be at any pressure, such as from 85 to 2000 pounds per sguare inch absolute (psia) or more. Feed 111 may contain other components in relatively small amounts. The other components include carbon dioxide and higher hydrocarbons such as ethane, propane, i-butane, and n-butane.

Cooled feed stream 112 is reduced in pressure by passage through valve 107. The pressure reduction through valve 107 generally causes some of stream 112 to vaporize and lowers the temperature of the feed stream. Resulting two-phase stream 113 is passed into phase separator 101 wherein it is divided into a nitrogen-enriched vapor portion 114 and a methane-enriched liquid portion 114.

The vapor portion, which has a greater concentration of nitrogen than does the feed, is passed 114 through heat exchanger 102 wherein it is condensed. The condensed stream 115 is then subcooled by passage through heat exchanger 103, subcooled stream 116 is reduced in pressure by passage through valve 108 and the resulting stream 117 is introduced into main column 104 which is operating at a pressure within the range of from 15 to 200 psia.

Within column 104 stream 117 and the other feed streams into column 104 which will be described later are separated by cryogenic rectification into nitrogen-richer vapor 131 and methane-richer liquid (125 and 127). Stream 117 serves to provide liquid reflux for this cryogenic rectification. In this embodiment of the invention, the liquid reflux is provided to column 104 without the need for a conventional high pressure column, thus serving to markedly reduced the capital costs, as well as the operating costs, of this embodiment of the process of this invention over those costs necessary for the operation of conventional double column nitrogen rejection processes.

The liquid portion of the partially condensed feed, which has a greater concentration of methane than does the feed, is passed 118 from phase separator 101 and is subcooled by passage through heat exchanger 105. Resulting subcooled stream 119 is divided into first part 120 and second part 121. First part 120 is reduced in pressure by passage through valve 110 and the resulting stream 124 is introduced into column 104, for separation by cryogenic rectification, at a point lower than the point at which stream 117 is introduced into the column.

The liquid stream 124 serves to provide additional liquid reflux to column 104 as well as to provide feed for the cryogenic rectification. The flow split between first part 120 and second part 121 will vary and is a function of the product specifications and the nitrogen concentration in feed 111. Generally as the nitrogen concentration of the feed increases, the fraction of liquid 119 which goes to form second part 121 decreases. Preferably when the nitrogen concentration of feed 111 is less than 35 mole percent, first part 120 comprises from 40 to 80 percent, and second part 121 comprises from 20 to 60 percent of subcooled liquid 119.

The second part 121 of subcooled liquid 119 is reduced in pressure by passage through valve 109 and the resulting stream 122 is at least partially vaporized by passage through heat exchanger 105 by indirect heat exchange with the subcooling liquid portion. Stream 122 may be completely vaporized, but preferably from about 5 to 30 percent of stream 122 is vaporized by the indirect heat exchange with the subcooling liquid in heat exchanger 105. The resulting stream 123 is introduced into column 104, for separation by cryogenic rectification, at a point lower than the point at which stream 124 is introduced into the column. The vapor of stream 123 serves to increase the amount of vapor upflow within column 104 as well as to provide feed for the cryogenic rectification. The additional vapor upflow is provided to distillation column vapor 104 without the need for a complicated heat pump circuit, thus serving to reduce the capital costs, as well as the operating costs, of the process of this invention over those costs associated with some other processes for the separation of nitrogen and methane.

Streams 117, 124, and 123 are introduced into column 104 wherein they are separated by cryogenic rectification into nitrogen-richer vapor and methane-richer liquid. Methane-richer liquid is removed from column 104 as stream 127, is pumped to a higher pressure through pump 106, and the resulting stream 128 is warmed by passage through heat exchanger 105 to form stream 129, further warmed by passage through heat exchanger 100 to form stream 130 and recovered as product methane. Generally stream 130 has a methane concentration of at least 80 mole percent and typically the methane concentration of stream 130 will be about 95 mole percent.

Reboiler duty for column 104 is provided by withdrawal of liquid stream 125 and partial vaporization of this stream by indirect heat exchange with condensing nitrogen-enriched vapor 114 in heat exchanger 102. Resulting two-phase stream 126 is returned to column 104. The vapor portion of stream 126 provides vapor upflow for column 104 and the liquid portion of stream 126 forms the methane-enriched liquid which is withdrawn from column 104 as stream 127.

Nitrogen-richer vapor is removed from column 104 as stream 131 and is warmed by indirect heat exchange through heat exchanger 103 with subcooling previously condensed stream 115. The resulting stream 132 is warmed by passage through heat exchanger 105 to form stream 133 and further warmed by passage through heat exchanger 100 to form stream 134 which may be recovered, reinjected into an oil or gas reservoir for enhanced hydrocarbon recovery, or simply released to the atmosphere. The concentration of nitrogen in stream 134 will vary depending upon the concentration of nitrogen in the feed and upon the degree of methane recovery.

As can be seen, the return streams from the column serve to transfer refrigeration from the column and the cryogenic separation to the incoming streams to effect the partial condensation of the feed in heat exchanger 100, and the subcooling of the feed in heat exchanger 105.

As previously discussd, the process of this invention serves to simultaneously increase the amount of liquid reflux and the amount of vapor boilup available for the cryogenic rectification this serving to eliminate tne need for a heat pump circuit previously necessary to provide the requisite flows to carry out the column separation especially at lower nitrogen feed concentrations such as below 35 mole percent. Moreover, the process of this invention eliminates the need for an upstream stripping column which has heretofore been employed when the feed contained a relatively low nitrogen concentration.

Figure 2:
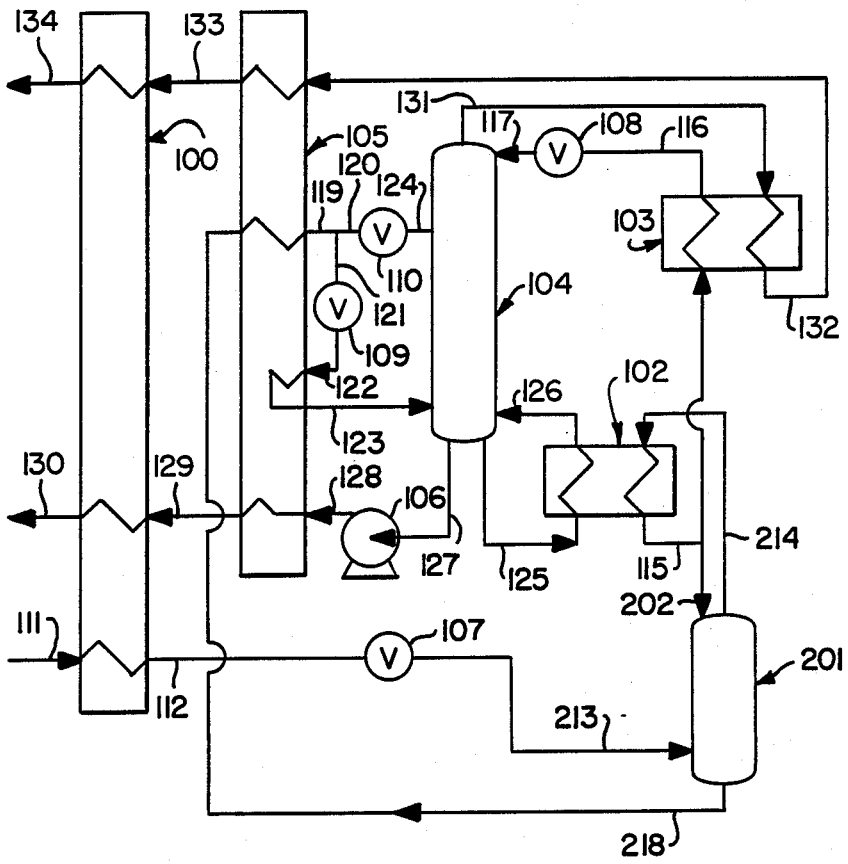
FIG. 2 is a schematic flow diagram of another embodiment of the nitrogen and methane separation process of this invention wherein the feed is separated into nitrogen-enriched vapor and methane-enriched liquid by use of a column.

FIG. 2 illustrates another embodiment of the nitrogen and methane separation process of this invention. The numerals of FIG. 2 correspond to those of FIG. 1 for the common elements. The embodiment illustrated in FIG. 2 differs from that illustrated in FIG. 1 essentially only in that the feed is separated into nitrogen-enriched vapor and methane enriched liquid by use of a high pressure column rather than a phase separator. The elements of the embodiment of FIG. 2 which are the same as those of the embodiment of FIG. 2 will not be specifically described again here.

Referring now to FIG. 2, the feed stream after passage through valve 107 is passed as stream 213 into high pressure column 201 at or near the bottom of the column. Stream 213 is generally partially condensed. Column 201 operates at a pressure which exceeds that at which main column 104 is operating and generally is at a pressure within the range of from 200 to 450 psia.

Within column 201 the feed is separated into nitrogen-enriched vapor and methane-enriched liquid by cryogenic rectification. Nitrogen-enriched vapor, having a nitrogen concentration exceeding that of feed 111, is removed from column 201 as stream 214, and methane-enriched liquid, having a methane concentration which exceeds that of feed 111, is removed from column 201 as stream 218. Streams 214 and 218 are passed to heat exchangers 102 and 105 respectively, from which the process of this embodiment is similar to that of the embodiment illustrated in FIG. 1 and, as such, the description will not be repeated. In the embodiment illustrated in FIG. 2, a portion 202 of stream 115 is passed into column 201 as liquid reflux for this column.

Generally, for any given set of feed conditions, the nitrogen concentration of stream 214 will exceed that of stream 114 and the methane concentration of stream 218 will exceed that of stream 118. Generally, the use of column 201 will allow greater liquid reflux to the top of column 104 and thereby allow higher recovery of the methane product.

Table 1 serves to report data obtained by a computer simulation of the process of this invention carried out using the embodiment illustrated in FIG. 1. The example is presented for illustrative purposes and is not intended to be limiting. The stream numbers recited in Table 1 correspond to the stream numbers of FIG. 1.

TABLE 1

| Stream No. | Flowrate (lb. mole/HR) | Temperature (°K.) | Pressure (PSIA) | Composition (Mole Percent) $N_2$ | $CH_4$ |
|---|---|---|---|---|---|
| 111 | 1000 | 155 | 250 | 20 | 80 |
| 112 | 1000 | 136 | 250 | 20 | 80 |
| 114 | 90 | 129 | 140 | 65 | 35 |
| 117 | 90 | 86 | 25 | 65 | 35 |
| 118 | 910 | 129 | 140 | 15 | 85 |
| 119 | 910 | 105 | 140 | 15 | 85 |
| 123 | 270 | 110 | 26 | 15 | 85 |
| 124 | 640 | 100 | 26 | 15 | 85 |
| 127 | 830 | 111 | 27 | 4 | 96 |
| 130 | 830 | 145 | 125 | 4 | 96 |
| 131 | 170 | 87 | 25 | 97 | 3 |
| 134 | 170 | 145 | 25 | 97 | 3 |
| 125 | 880 | 107 | 27 | 7 | 93 |

Now by the use of the process of this invention one can effectively and efficiently separate nitrogen and methane by cryogenic rectification without need for an upstream stripping column or a heat pump loop to transfer refrigeration, thus resulting in lower capital costs and operating costs over those reguired for heretofore known processes.

Although the process of this invention has been described in detail with reference to certain preferred embodiments, those skilled in the art will recognize that there are other embodiments of the invention within the spirit and scope of the claims.

We claim:

1. A process for separating nitrogen and methane comprising (A) separating a feed comprising methane and nitrogen into a nitrogen-enriched vapor portion and a methane-enriched liquid, portion;

(B) condensing the nitrogen-enriched vapor portion and introducing resulting condensed nitrogen-enriched vapor into a main column operating within the range of from 15 to 200 psia;

(C) subcooling the methane-enriched liquid portion and dividing resulting subcooled methane-enriched liquid into first and second parts;

(D) introducing the first part into said main column;

(E) at least partially vaporizing the second part by indirect heat exchange with said subcooling methane-enriched liquid portion;

(F) introducing the at least partially nitrogen-enriched vaporized second part into said main column;

(G) separating the condensed vapor portion, subcooled first part, and at least partially vaporized second part by cryogenic rectification within the main column into nitrogen-richer vapor and methane-richer liquid; and (H) removing nitrogen-richer vapor and methane-richer liquid from the main column.

2. The process of claim 1 wherein the condensed nitrogen-enriched vapor is subcooled prior to being introduced into the column.

3. The process of claim 2 wherein the condensed nitrogen-enriched vapor is subcooled by indirect heat exchange with nitrogen-richer vapor.

4. The process of claim 1 wherein the first part of the subcooled methane-enriched liquid comprises from 40 to 80 percent and the second part comprises from 20 to 60 percent of the subcooled methane-enriched liquid.

5. The process of claim 1 wherein from 5 to 30 percent of the second part is vaporized by the heat exchange with the subcooling methane-enriched liquid portion.

6. The process of claim 1 wherein the subcooling methane-enriched liquid portion is subcooled additionally by indirect heat exchange with at least one of the nitrogen-richer vapor and the methane-richer liquid.

7. The process of claim 1 wherein the methane-richer liquid is pumped to a higher pressure than that at which it is removed from the column.

8. The process of claim 1 wherein the methane-richer liquid is recovered as methane product comprising at least 80 mole percent methane.

9. The process of claim 1 wherein the nitrogen concentration in the feed is within the range of from 5 to 80 mole percent.

10. The process of claim 1 wherein the nitrogen concentration in the feed is less than 35 mole percent.

11. The process of claim 1 wherein the feed is separated into nitrogen-enriched vapor and methane-enriched liquid by partially condensing the feed and passing the partially condensed feed into a phase separator from which the nitrogen-enriched vapor and methane-enriched liquid are removed.

12. The process of claim 11 wherein the feed is partially condensed by indirect heat exchange with at least one of the nitrogen-richer vapor and the methane-richer liquid.

13. The process of claim 1 wherein the feed is separated into nitrogen enriched vapor and methane-enriched liquid by passing the feed into a high pressure column, operating at a pressure which exceeds that at which the main column is operating, separating the feed by cryogenic rectification within the high pressure column, and removing the nitrogen-enriched vapor and methane enriched liquid from the high pressure column.

14. The process of claim 13 wherein the high pressure column is operating at a pressure within the range of from 200 to 450 psia.

15. The process of claim 13 wherein a portion of the condensed nitrogen-enriched vapor is passed into the high pressure column to serve as liquid reflux.

* * * * *

UNITED STATES PATENT AND TRADEMARK OFFICE

CERTIFICATE OF CORRECTION

PATENT NO. : 4,878,932

DATED : November 7, 1989

INVENTOR(S) : R. F. Pahade et al

It is certified that error appears in the above-identified patent and that said Letters Patent is hereby corrected as shown below: On the title page In the inventor's name delete "Phade" and insert therefor --Pahade--.

In the filing date delete "1988" and insert therefor --1989--.

In column 2, line 49 delete "liguid" and insert therefor --liquid--.

In column 2, line 52 delete "liguid" and insert therefor --liquid--.

In column 2, line 59 delete "liguid" and insert therefor --liquid--.

In claim 1 lines 17 and 18 delete "nitrogen-enriched".

In claim 1 line 20 after "condensed" insert --nitrogen-enriched--.

Signed and Sealed this

Twenty-third Day of October, 1990

*Attest:*

HARRY F. MANBECK, JR.

*Attesting Officer*

*Commissioner of Patents and Trademarks*